US007793516B2

(12) United States Patent
Farrow et al.

(10) Patent No.: US 7,793,516 B2
(45) Date of Patent: Sep. 14, 2010

(54) ROTARY COMPRESSOR WITH FLUIDIC PASSAGES IN ROTOR

(75) Inventors: Timothy Samuel Farrow, Cary, NC (US); Albert Vincent Makley, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 372 days.

(21) Appl. No.: 11/536,977

(22) Filed: Sep. 29, 2006

(65) Prior Publication Data

US 2008/0229781 A1 Sep. 25, 2008

(51) Int. Cl.

| | |
|---|---|
| ***F25B 1/00*** | (2006.01) |
| ***F02B 53/00*** | (2006.01) |
| ***F02B 53/06*** | (2006.01) |
| ***F02B 53/04*** | (2006.01) |
| ***F02B 53/10*** | (2006.01) |
| ***F02B 53/12*** | (2006.01) |

(52) U.S. Cl. ..... 62/498; 418/183; 418/186; 418/187; 418/188; 123/200; 123/201; 123/202; 123/203; 123/204; 123/205; 123/206; 123/207; 123/208; 123/209; 123/210; 123/211; 123/212; 123/213; 123/214; 123/215; 123/216; 123/217; 123/218; 123/219; 123/220; 123/221; 123/222; 123/223; 123/224; 123/225; 123/226; 123/227; 123/228; 123/229; 123/230; 123/231; 123/232; 123/233; 123/234; 123/235; 123/236; 123/237; 123/238; 123/239; 123/240; 123/241; 123/242; 123/243; 123/244; 123/245; 123/246; 123/247; 123/248; 123/249

(58) Field of Classification Search ..... 62/498; 418/183, 186, 187, 188; 123/200–249

See application file for complete search history.

(56) References Cited

U.S. PATENT DOCUMENTS

| | | | | |
|---|---|---|---|---|
| 3,922,120 | A * | 11/1975 | McCullough et al. | 418/5 |
| 5,152,156 | A * | 10/1992 | Tokairin | 62/498 |
| 6,045,343 | A * | 4/2000 | Liou | 418/91 |
| 2006/0118078 | A1 * | 6/2006 | Coffland | 123/249 |

* cited by examiner

*Primary Examiner*—Thomas E Denion
*Assistant Examiner*—Michael Carton
(74) *Attorney, Agent, or Firm*—Patrick J. Daugherty; Driggs, Hogg, Daugherty & Del Zoppo Co., LPA

(57) ABSTRACT

The problems of prior compressor structures relying upon conventional check valves are obviated by using, instead, flow control passages which operate to control flow while avoiding mechanical moving elements which may become problematical.

18 Claims, 5 Drawing Sheets

ROTARY COMPRESSOR WITH FLUIDIC PASSAGES IN ROTOR

FIELD AND BACKGROUND OF INVENTION

This invention relates to flow control in a compressor and more particularly to arrangements which obviate the need for more conventional check valves.

The has been a proposal to use a trilobal impeller or rotor within a quadrilateral housing to move a fluid, such as a refrigerant fluid, from a region of low pressure to a region of higher pressure, in a manner consistent with the operation or prior art compressors. In such devices, conventional check valves, formed with spring loaded balls seated on seats, have been used to control flow through the compressor. Such check valves, while long used in such applications and well known, have known mechanical failures, including sticking or becoming unseated, which impair or prevent compressor operation.

SUMMARY OF THE INVENTION

The present invention contemplates that the problems of prior compressor structures relying upon conventional check valves may be obviated by using, instead, flow control passages which operate to control flow while avoiding mechanical moving elements which may become problematical. In realizing this purpose of the invention, reliance is placed upon specifically configured flow passages, which dynamically direct fluid flow to achieve the desired functionality.

BRIEF DESCRIPTION OF DRAWINGS

Some of the purposes of the invention having been stated, others will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of the invention. Accordingly, the description which follows is to be understood as being a broad, teaching disclosure directed to persons of skill in the appropriate arts, and not as limiting upon the present invention.

Figure 1:
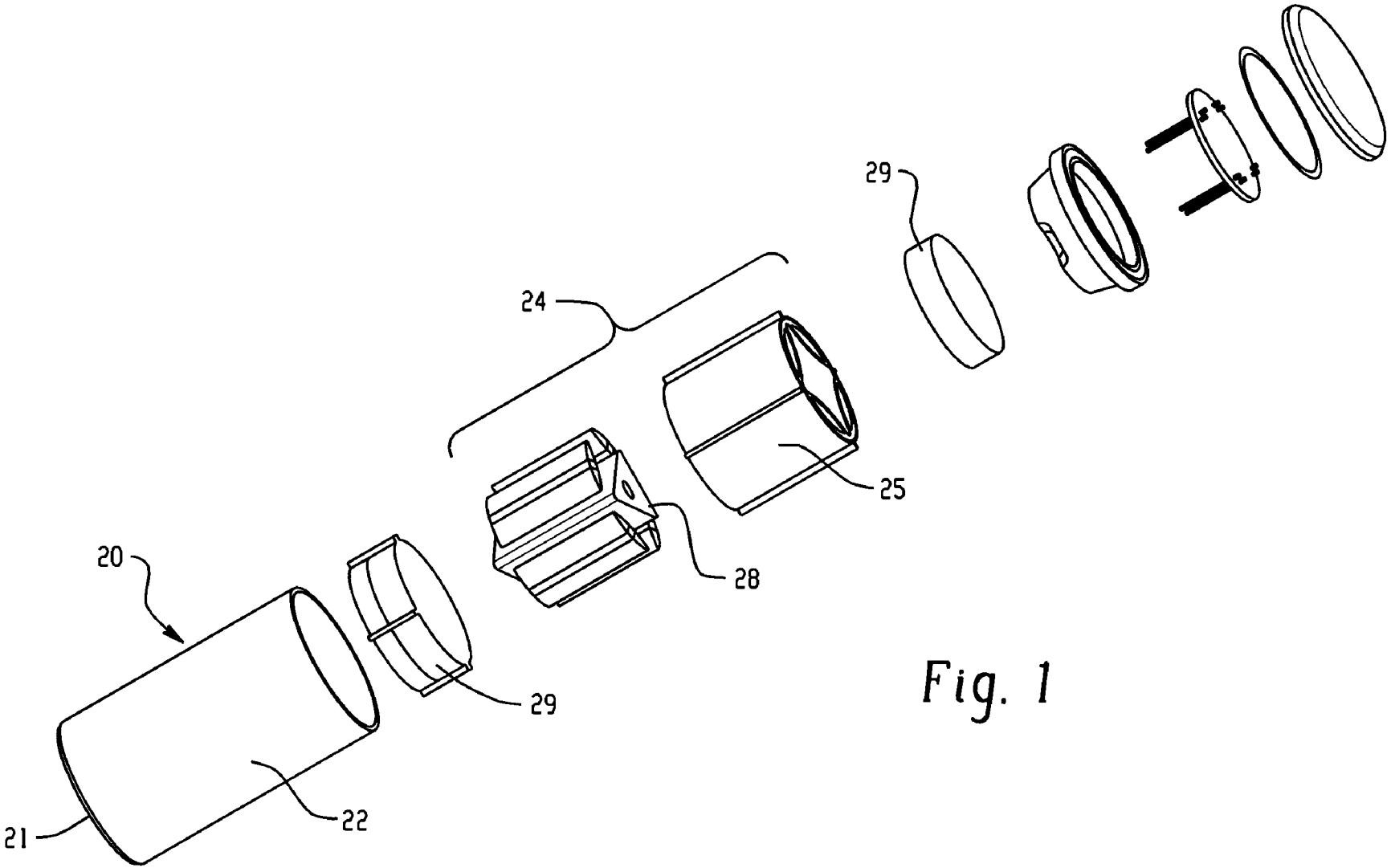
FIG. 1 is an exploded assembly view of the elements of a compressor structure in which the present invention finds utility.
Figure 2:
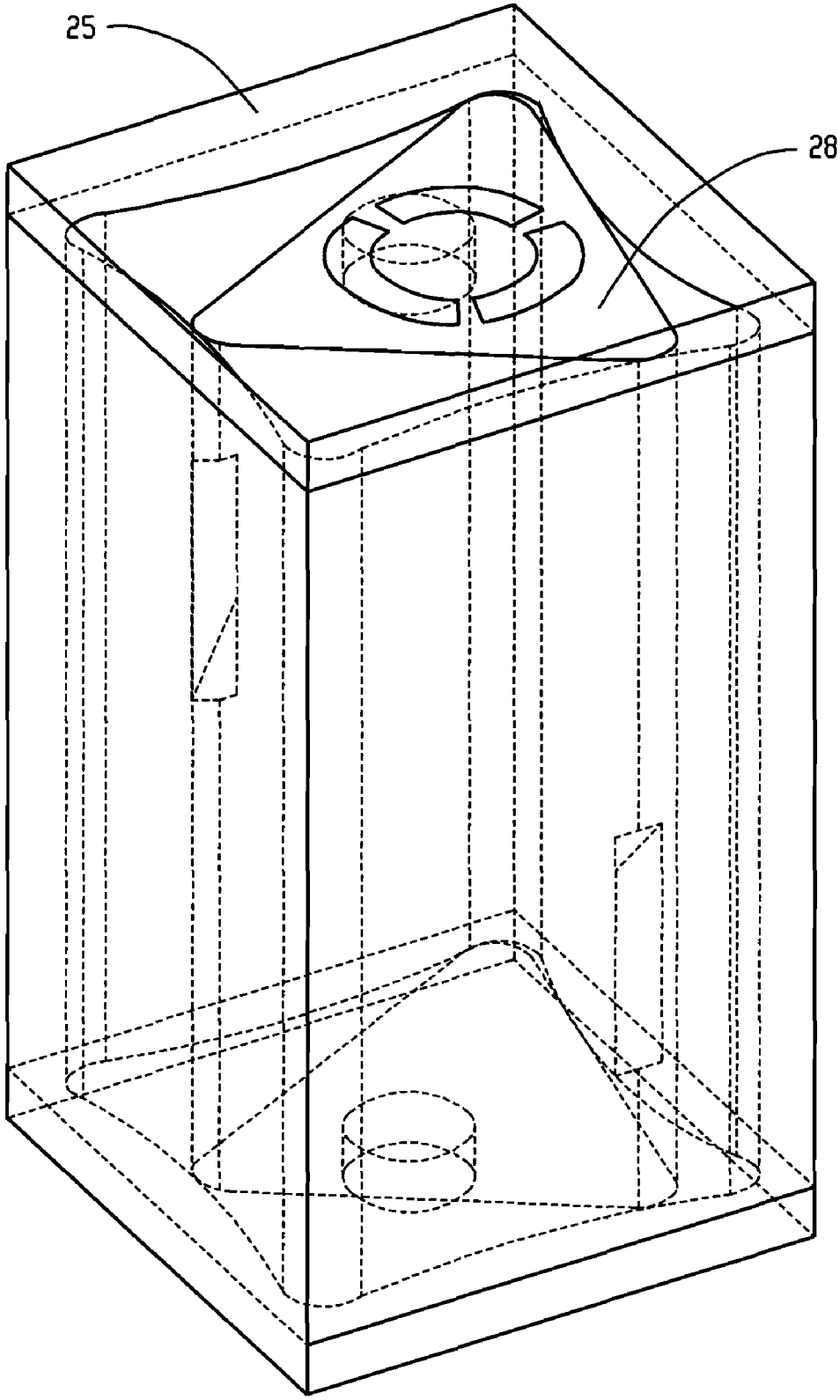
FIG. 2 is a perspective view, partially in phantom lines, of elements of the apparatus of FIG. 1, implementing a first embodiment of this invention.

FIG. 1 shows an exploded assembly view of an apparatus which includes a compressor stage in accordance with this invention. The apparatus illustrated is an electro mechanical refrigeration device, operating on the Carnot cycle of expansion or evaporation of a fluid to absorb heat, compression of the expanded fluid, and condensation of the compressed fluid to transfer the absorbed heat. This particular application of this invention, which providing a context for the description which follows, is contemplated as being only one environment in which the invention to be described has utility and is not limiting on the usefulness of the invention.

The compressor stage is housed within an enclosure or can 20 which also provides evaporator and condenser surfaces for heat transfer. Within the can 20 are disposed an evaporator section 21, formed in the bottom of the can 20 and a condenser section 22, formed in the cylindrical wall of the can 20. Functioning with these sections is a compressor stage 24. One way to describe the refrigeration component would be to call it a heat pump in a can.

The compressor stage 24 has a housing 25 within which is mounted a trilobal rotor 28, drawing a refrigerant fluid from the evaporator section 21 discharging compressed refrigerant fluid into the condenser section 22.

The housing 25 defines an interior cavity which is four lobed. That is, there are four curved walls which together define a quadrilateral volume with convex inward walls. Within those walls is disposed the trilobal rotor or impeller 28. The rotor 28, when driven in rotation, moves fluid from the low pressure region of the evaporator section to the high pressure region of the condenser. This function of moving fluid from a region of low pressure to a region of higher pressure will be understood as being characteristic of compressors generally.

Figure 6:
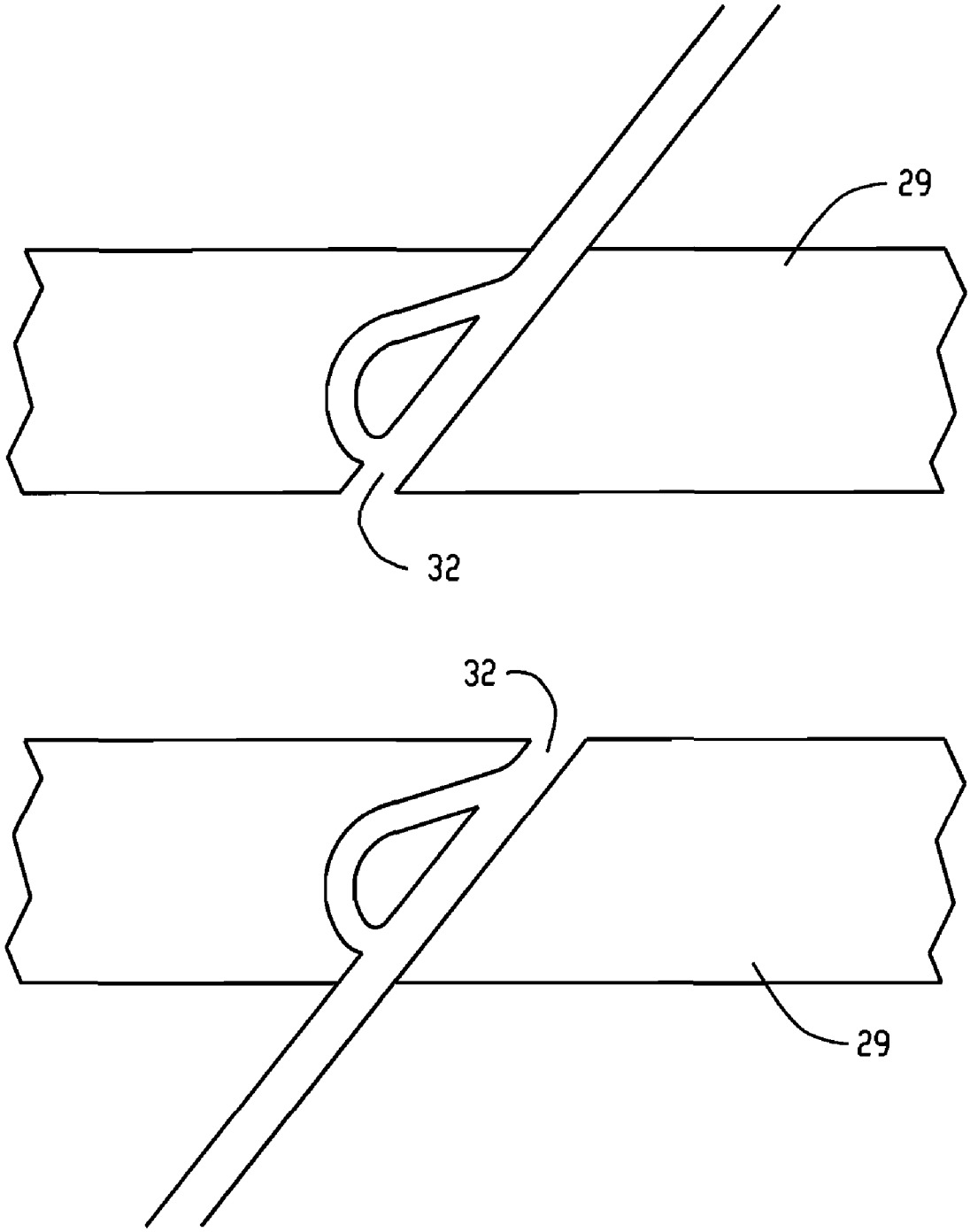
FIG. 6 is an enlarged section view through certain end cap portions of the apparatus of FIG. 1, showing a second embodiment of this invention.

In accordance with this invention, control over this flow toward the regions of higher pressure is accomplished by especially configured passageways in one of said housing and said rotor and cooperating therewith in directing flow through said housing and said rotor from a region of low pressure to a region of higher pressure. Two embodiments are disclosed which function independently one of the other. The first embodiment is shown in FIGS. 2 through 5, in which the passages are defined in the rotor 28. The second embodiment is shown in FIG. 6, in which the passages are defined in end caps 29 of the assembly of FIG. 1.

Turning now to FIGS. 2 through 5, the rotor 28 has passageways which extend through the material of the rotor from locations adjacent the end points of lobes to locations in the end faces of the rotor. One set of passageways are disposed to extend from the end face adjacent the evaporator section (the region of lowest pressure) to lobe edges which will access a volume between the housing 25 and rotor 28 which is expanding during rotation of the rotor. Thus the passageways admit fluid from the evaporator into an expanding volume, drawing the fluid into the compressor device. Another set of passageways extend from an end face adjacent the condenser section to lobe edges which access a volume between the housing 25 and rotor 28 which is contracting during rotation of the rotor. Thus the passageways admit fluid from the compressing volume, expelling fluid from the compressor device into the condenser.

Figure 3:
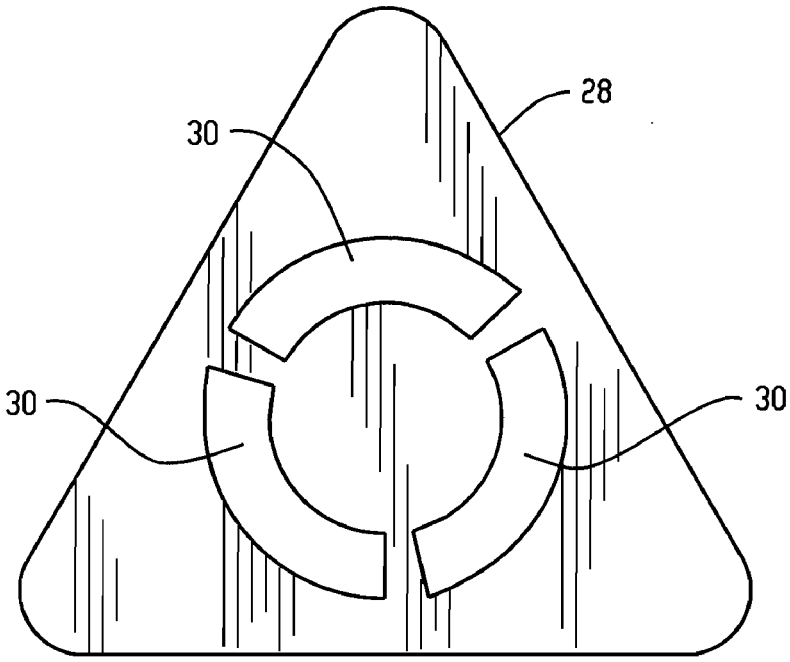
FIG. 3 is view from an end of the rotor of the apparatus of FIG. 2.

FIG. 3 shows a view of the end face of the rotor 28, illustrating the openings 30 of the passageways. In this form, the end caps 29 have openings with a diameter which allows the appropriate passageway to open as the rotor rotates about a center of rotation which is axial to the housing 25 and offset from the axis of the rotor. This non-axial rotation is a consequence of the movement of the trilobal rotor within the quadrilateral walls of the housing.

Figure 4:
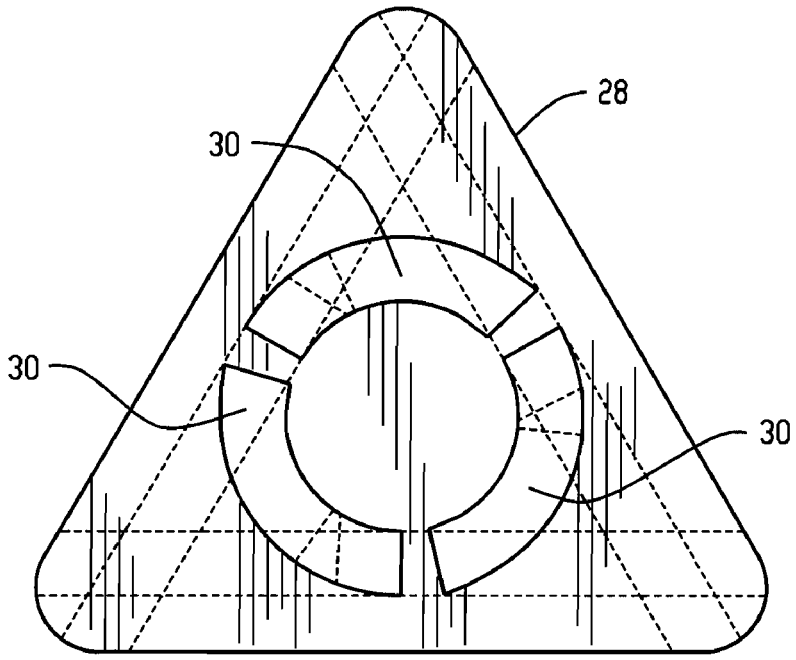
FIG. 4 is a view similar to FIG. 3, showing in phantom lines certain passageways through the rotor.
Figure 5:
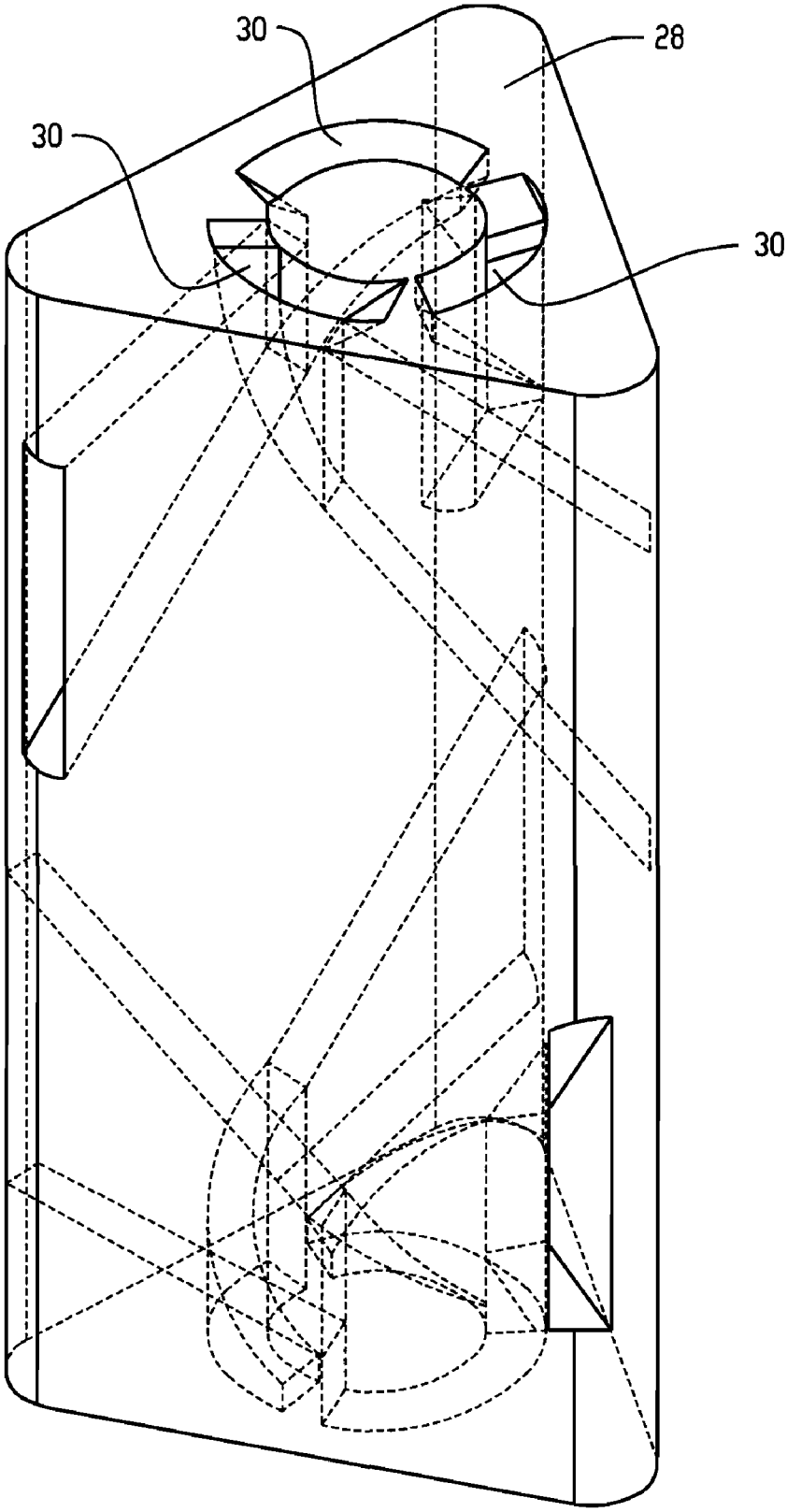
FIG. 5 is a view similar to FIG. 2 of the rotor, showing in phantom lines the passageways also shown in FIG. 4.

FIG. 4 is similar to FIG. 3, showing in phantom lines the passageways formed within the rotor and extending from end faces to lobe edges. As will be understood, the passageways for admitting fluid extend from one end face of the rotor while the passageways for discharging fluid extend from the opposite end face. This is made more clear in FIG. 5 where the passageways are again shown in phantom lines.

A second embodiment for this invention is shown in FIG. 6. There, the rotor 28 (not shown) is a solid body lacking the passageways of FIGS. 2 through 5. Instead, the end caps 29 have formed therein passageways 32 with a particular configuration which enable them to function as fluidic check valves. That is, the dynamics of fluid flow from a region of lower pressure toward a region of higher pressure causes flow to be controlled. Each passageway 32 enters relevant region at an angle to the center of rotation of the rotor and defines a main channel extending at an angle to the center of rotation of the rotor and a diverting loop adjacent the entry of the main channel into the region. In operation, when a fluid seeks to flow from the region of higher pressure toward the region of lower pressure, a portion of the flow is diverted along the loop and redirected backward against the main channel, stopping the flow of the fluid from the higher pressure region toward the lower pressure region.

In the drawings and specifications there has been set forth a preferred embodiment of the invention and, although specific terms are used, the description thus given uses terminology in a generic and descriptive sense only and not for purposes of limitation.

What is claimed is:

1. Apparatus comprising:
an enclosure;
a housing defining a chamber;
a trilobal rotor mounted within said housing for rotation within said chamber and relative thereto;
said housing and rotor being housed within said enclosure;
said housing and rotor cooperating in compressing a fluid flowing there through; and
a passageway formed in said housing and defined in end caps disposed on opposing ends of said housing and cooperating therewith in directing flow through said housing and said rotor from a region of low pressure in a first section formed in one end of the enclosure to a region of higher pressure in a second section formed in a wall of the enclosure without a mechanical check valve.

2. Apparatus according to claim 1 wherein said passageway enters said chamber at an angle to a longitudinal center of rotation of said rotor and defines a fluidic check valve.

3. Apparatus according to claim 2 wherein said passageway defines a main channel and a diverting loop adjacent the entry of said main channel into said chamber, wherein the diverting loop is configured to divert a portion of the flow along the diverting loop and redirect the flow backward against the main channel, thereby stopping the flow from the high pressure region toward the low pressure region without a mechanical check valve.

4. Apparatus comprising:
an enclosure;
a housing defining a chamber;
a trilobal rotor mounted within said housing for rotation within said chamber and relative thereto;
said housing and rotor being housed within said enclosure;
said housing and rotor cooperating in compressing a fluid flowing there through; and
at least one passageway defined in one of said housing and said rotor and cooperating therewith in directing flow through said housing and said rotor from a region of low pressure in an evaporator formed in one end of the enclosure to a region of higher pressure in a second section formed in a wall of the enclosure without a mechanical check valve.

5. Apparatus according to claim 4 wherein said at least one passageway is two sets of passageways formed in said rotor and one of the two sets of passageways is configured to admit fluid from the first section into an expanding volume and draw the fluid into the housing, and a second of the two sets of passageways is configured to admit fluid from a compressing volume and expel the fluid from the housing into the second section.

6. Apparatus according to claim 5 wherein said rotor has end faces and working faces, said working faces meeting at lobe terminations of said rotor and further wherein said passageways extend from a location on a working face adjacent a lobe termination to a location on an end face spaced from the center of rotation of said rotor.

7. Apparatus according to claim 6 wherein said housing has end walls defining portions of said chamber and adjacent said end faces of said rotor, said housing end walls further defining ports for fluid passage there through, said ports opening in alignment with a circle described by the center of rotation of said rotor.

8. Apparatus comprising:
an enclosure;
an evaporator formed in one end of the enclosure;
a condenser formed in a wall of the enclosure; and
a compressor housed in the enclosure and coupled with said evaporator and condenser for circulating a refrigerant material there amongst;
said compressor having:
a housing defining a chamber;
a trilobal rotor mounted within said housing for rotation within said chamber and relative thereto;
said housing and rotor cooperating in compressing a fluid flowing there through; and
at least one passageway defined in one of said housing and said rotor and cooperating therewith in directing flow through said housing and said rotor from a region of low pressure in the evaporator to a region of higher pressure in the condenser without a mechanical check valve.

9. Apparatus according to claim 8 wherein said at least one passageway is formed in said housing and defined in end caps disposed on opposing ends of said housing.

10. Apparatus according to claim 9 wherein said at least one passageway enters said chamber at an angle to a longitudinal center of rotation of said rotor and defines a fluidic check valve.

11. Apparatus according to claim 10 wherein said at least one passageway defines a main channel and a diverting loop adjacent the entry of said main channel into said chamber, wherein the diverting loop is configured to divert a portion of the flow along the diverting loop and redirect the flow backward against the main channel, thereby stopping the flow from the higher pressure region toward the lower pressure region without a mechanical check valve.

12. Apparatus according to claim 8 wherein said at least one passageway is two sets of passageways formed in said rotor and a one the two sets of passageways is configured to admit fluid from the first section into an expanding volume and draw the fluid into the housing, and a second of the two sets of passageways is configured to admit fluid from a compressing volume and expel the fluid from the housing into the second section.

13. Apparatus according to claim 12 wherein said rotor has end faces and working faces, said working faces meeting at lobe terminations of said rotor and further wherein said passageways extend from a location on a working face adjacent a lobe termination to a location on an end face spaced from the center of rotation of said rotor.

14. Apparatus according to claim 13 wherein said housing has end walls defining portions of said chamber and adjacent said end faces of said rotor, said housing end walls further defining ports for fluid passage there through, said ports opening in alignment with a circle described by the center of rotation of said rotor.

15. Apparatus comprising:

an enclosure;

a housing defining a chamber;

a trilobal rotor mounted within said housing for rotation within said chamber and relative thereto;

said housing and rotor being housed within said enclosure;

said housing and rotor cooperating in compressing a fluid flowing there through; and at least one passageway defined in one of said housing and said rotor and cooperating therewith in directing flow through said housing and said rotor from a region of low pressure in a first section formed in one end of the enclosure to a region of higher pressure in a condenser formed in a wall of the enclosure without a mechanical check valve.

16. Apparatus according to claim 15 wherein said passageway is two sets of passageways formed in said rotor and one of the two sets of passageway is configured to admit fluid from the first section into an expanding volume and draw the fluid into the housing, and a second of the two sets of passageways is configured to admit fluid from a compressing volume and expel the fluid from the housing into the second section.

17. Apparatus according to claim 16 wherein said rotor has end faces and working faces, said working faces meeting at lobe terminations of said rotor and further wherein said passageways extend from a location on a working face adjacent a lobe termination to a location on an end face spaced from the center of rotation of said rotor.

18. Apparatus according to claim 17 wherein said housing has end walls defining portions of said chamber and adjacent said end faces of said rotor, said housing end walls further defining ports for fluid passage there through, said ports opening in alignment with a circle described by the center of rotation of said rotor.

* * * * *